US005664618A

United States Patent [19]

Kai et al.

[11] Patent Number: 5,664,618

[45] Date of Patent: Sep. 9, 1997

[54] INJECTION MOLDING APPARATUS

[75] Inventors: Masayoshi Kai; Kazuya Sakamoto; Atsushi Suzuki; Nobumasa Hamazoe; Hiroshi Mizutani; Hiromitsu Suganuma, all of Sayama, Japan

[73] Assignee: Honda Giken Kogyo Kabushiki Kaisha, Japan

[21] Appl. No.: 620,027

[22] Filed: Mar. 21, 1996

[30] Foreign Application Priority Data

| | | | |
|---|---|---|---|
| Mar. 22, 1995 | [JP] | Japan | 7-063185 |
| Mar. 22, 1995 | [JP] | Japan | 7-063195 |
| Mar. 24, 1995 | [JP] | Japan | 7-065441 |

[51] Int. Cl.[6] ..... B22D 17/10; B22D 17/30

[52] U.S. Cl. ..... 164/312; 164/900

[58] Field of Search ..... 164/71.1, 900, 164/113, 312

[56] References Cited

FOREIGN PATENT DOCUMENTS 5-285625 11/1993 Japan .
5-285626 11/1993 Japan .

*Primary Examiner*—Kuang Y. Lin
*Attorney, Agent, or Firm*—Merchant, Gould, Smith, Edell, Welter & Schmidt

[57] ABSTRACT

An upper unit of an injecting molding apparatus includes an ingot entry for introducing into the apparatus an ingot to be molded and an ingot heating chamber for heating the ingot supplied via the entry, and a lower unit includes a crusher for crushing the heated ingot and an injecting machine having an axially movable screw shaft for slurring and injecting the crushed ingot into a mold. The upper and lower units are interconnected via a flexible connector unit which is flexible in a vertical direction to allow the lower unit to vertically displace relative to the upper unit. By disengaging the connector unit from the upper unit, the lower unit can be disconnected from and laterally pivoted with respect to the upper unit to permit easy access to both the units. This displacement of the lower unit permits facilitated maintenance operations of the apparatus. A lower door provided for openably closing an ingot exit hole of the heating chamber is a vertically pivotable door that does not require a large operating space.

9 Claims, 14 Drawing Sheets

INJECTION MOLDING APPARATUS

BACKGROUND OF THE INVENTION

1. Field of the Invention

The present invention relates generally to injection molding apparatuses, for manufacturing metal molded articles, which comprise an upper unit including an ingot entry and an ingot heating chamber, and a lower unit including a crushing chamber provided with cutters and an injecting machine provided with a screw shaft.

More particularly, the present invention relates to an improved injection molding apparatus which, with a simple construction, can reliably absorb undesirable thermal expansion of the lower unit and mechanical shocks and vibrations caused in the lower unit by the injecting action of the injecting machine.

The present invention also relates to an improved injection molding apparatus which, with a simple construction, permits easy access to the upper and lower units for facilitated maintenance operations of the apparatus.

The present invention also relates to an improved mechanism for sealing an ingot heating chamber in an injection molding apparatus, which comprises an upper door for openably closing the top of the heating chamber and lower door for openably closing the bottom of the heating chamber and which can reliably seal the heating chamber in a predetermined atmospheric condition by means of the upper and lower doors without requiring a large operating space for the lower door and without the lower door being damaged by a heated ingot.

2. Description of the Related Art

In Japanese Patent Laid-open Publication No. HEI 5-285625, the assignee of the present invention proposes an injection molding apparatus for manufacturing metal molded articles, which is designed to increase productivity by heating and slurring an ingot in successive operations as will be outlined below with reference to FIG. 16.

FIG. 16 is a vertical sectional view schematically showing the proposed injection molding apparatus 100, which generally comprises a screw-type injecting machine 101 including a screw shaft 111 axially movable within a machine cylinder and having a spiral groove along a predetermined length thereof, and a material feeder section 102. The material feeder section 102 includes, in the top-to-bottom direction of the figure, an ingot entry 103, ingot heating chamber 104 provided with an inductive heater, and crushing chamber 107 having rotary cutters 106. The crushing chamber 107 is connected in communication with the heating chamber 104 via a heat-retaining chamber 105. The interior of the entire material feeder section 102 is maintained in a vacuum or inert gas atmosphere, and the above-mentioned chambers 103, 104 and 105 are partitioned off by sliding shutters 108 and 109.

In the proposed injection molding apparatus 100, an ingot 110 fed via the ingot entry 103 is heated in the heating chamber 104 into a half-molten condition and passed through the chamber 105 to the crushing chamber 107 to be crushed by the rotary cutters 106. Then, the crushed ingot pieces are introduced into the injecting machine 101, where they are agitated and kneaded into slurry by rotation of the screw shaft 111 and temporarily accumulated in the tip end portion of the cylinder as a final slurried material to be molded. Once a predetermined amount of the slurried material has been accumulated, it is directly or indirectly injected through a nozzle into a cavity 113 of a metal mold 112 by injecting action of the screw shaft 111. Because the ingot 110 is heated in the heating chamber 104, passed through the heat-retaining chamber 105 and then cut into pieces by the cutters 106, the necessary injecting operations of the apparatus 100 can be carried out in succession, which thus promotes increased productivity of the apparatus 100.

In the injection molding apparatus 100, the injecting machine 101, crushing chamber 107 and heat-retaining chamber 105 together constitute a lower unit of the molding apparatus 100, while the heating chamber 104 and ingot entry 103 together constitute an upper unit of the apparatus 100. The lower unit is mounted on a support base 114, and the upper unit is fixedly connected to the lower unit via bolts and other forms of complicated joints. In the lower unit of the apparatus 100, the material supplied from the upper unit is crushed while being retained at a predetermined high temperature and then fed into the injecting machine 101, where it is also retained at the high temperature, accumulated, again heated if necessary, and finally forced out to the mold 112.

Generally, in prior art injection molding apparatuses such as the above-mentioned apparatus 100, the outer atmospheric temperature around the upper unit including the heating chamber is compulsorily maintained cold to prevent overheating by the heating chamber, but the outer atmospheric temperature around the lower unit is left warm for the above-mentioned heat-retaining purposes. Consequently, the lower unit tends to thermally expand upward, so that there would arise a substantial mechanical interference in the connection between the upper and lower units. Additionally, the injecting action of the injecting machine in the lower unit involves considerable mechanical shocks and vibrations, which are transmitted to the upper unit by way of the various components of the lower unit. Such shocks and vibrations transmitted would sometimes damage the ingot in the entry of the upper unit.

Further, in the prior art injection molding apparatuses, the feeding of the ingot to the entry, heating chamber, crushing chamber and injecting machine is via a sealed continuous passage within the apparatus; while, the heating and crushing of the ingot and slurring and injecting of the crushed ingot within the injecting machine are executed in an inert gas atmosphere in order to prevent unwanted oxidation of the ingot. The inductive heater in the heating chamber, the cutters in the crushing chamber, the nozzle and screw shaft in the injecting machine, etc. would fail or wear due to their long-time use, and thus these components need to undergo maintenance operations such as inspection, repair, part replacement, etc. from time to time or on a periodical basis.

However, for maintenance operations of the prior art molding apparatuses, at least the upper and lower units must be disconnected from each other by releasing the bolts and other joints and then must be separated enough for easy access thereto by a human operator. Therefore, the maintenance operations were very difficult and time-consuming. Besides, the prior art molding apparatuses required a large space for the separation of the upper and lower units.

Further, in the prior art injection molding apparatuses, the heating chamber must be hermetically sealed to reliably remain in a vacuum or inert gas atmosphere. One approach is disclosed in Japanese Patent Laid-open publication No. HEI 5-285626, where sliding shutters or doors are provided in the upper and lower portions of the heating chamber so as to seal between the ingot entry, heating chamber and crushing chamber. However, it was difficult to attain reliable sealing by the lower door disclosed in the 5-185626 publication. In addition, even if the reliable sealing is attained at all, a relatively large space would be required for sliding the doors to open. In particular, because the lower door is slid with the heated ingot placed thereon, it would easily wear and get damaged by the heated ingot as it slides relative to the ingot for opening or closing the heating chamber.

SUMMARY OF THE INVENTION

It is therefore an object of the present invention to provide an injection molding apparatus for manufacturing a metal molded article which, with a simple construction, can reliably absorb thermal expansion of the lower unit and mechanical shocks and vibrations caused in the lower unit by the injecting action of the injecting machine.

It is another object of the present invention to provide an injection molding apparatus which, with a simple construction, permits easy access to the upper and lower units for facilitated maintenance operations of the apparatus.

It is, still another object of the present invention to provide a sealing mechanism for an ingot heating chamber in an injection molding apparatus, which comprises an upper door for openably closing the top of the heating chamber and a lower door for openably closing the bottom of the heating chamber and which can reliably seal the heating chamber in a predetermined atmospheric condition by means of the upper and lower doors without requiring a large operating space for the lower door and without the lower door being damaged by a heated ingot.

The present invention is applied to an injection molding apparatus which comprises an upper unit including an ingot entry for introducing into the apparatus an ingot to be molded and an ingot heating chamber for heating the ingot supplied via the entry to a predetermined temperature, and a lower unit disposed below the upper unit and including a crushing chamber for crushing the ingot heated by the heating chamber and an injecting machine having a screw shaft for slurring and injecting the ingot crushed by the crushing chamber into a mold. The lower unit is mounted on a support base, and the upper unit placed on the lower unit is supported on an upper unit support independently of the lower unit.

According to a first inventive feature of the invention thus arranged, a flexible connector unit is provided for interconnecting the upper and lower units so that the heated ingot is transferred from the heating chamber to the crushing chamber through the connector unit. The connector unit is flexible in a vertical direction between the upper unit and the lower unit mounted on the support base.

Although the heating chamber is included in the upper unit for initially heating the ingot to a predetermined temperature, the outer atmospheric temperature around the upper unit is compulsorily maintained lower than that around the lower unit which is left warm to retain the high temperature of the heated ingot, as in the prior art apparatuses. Consequently, the crushing chamber, etc. of the warm lower unit tends to thermally expand upwardly toward the upper unit fixed independently of the lower unit. However, such thermal expansion of the lower unit can be absorbed reliably and smoothly by the vertical or axial contraction of the connector unit between the upper and lower units, and hence it is possible to achieve a smooth injection molding operation of the apparatus by mere provision of the simply-constructed connector unit.

Further, the slurry injecting action of the screw shaft in the injecting machine would cause considerable mechanical shocks and vibrations, which are transmitted via various components of the lower unit to the upper unit may even cause serious damage to the ingot in the ingot entry. However, according to the present invention arranged in the above-mentioned manner, such shocks and vibrations caused during the injection operation in the lower unit can also be absorbed by the vertical flexibility of the connector unit so that transmission to the upper unit of the shocks and vibrations is avoided or greatly reduced. This also permits stable and smooth supply of defect-free ingots from the entry.

Most preferably, the flexible connector unit comprises heat-resistant metal bellows, and a cylindrical ingot guide disposed within the bellows for guiding the heated ingot from the heating chamber toward the lower unit. The respective upper ends of the bellows and ingot guide are together fastened to the lower end of the upper unit, while the lower end of only the bellows is fastened to the upper end of the lower unit with the lower end of the ingot guide left unfastened to permit free vertical expansion and contraction of the bellows independently of the ingot guide. Preferably, the ingot guide extends substantially along the full vertical length of the bellows so as to protect the bellows from being directly interfered with or damaged by the ingot.

According to a second inventive feature of the molding apparatus, the support base is movable toward and away from the mold together with the lower unit mounted thereon and also the upper unit connected with the lower unit via the connector unit. The support base is also laterally pivotable about a predetermined pivot together with the lower while the upper unit remains fixed in position on the upper unit support. By movement of the support base toward and away from the mold, the lower unit is movable between an advanced position where the screw shaft of the injecting machine is advanced to partly project into the mold so as to inject the slurried ingot thereinto and a retracted position where the screw shaft is away from the mold. In the retracted position, the lower unit is also laterally pivotable with respect to the upper unit by disengaging the connector unit from the upper unit and by subsequently causing the support base to laterally pivot about the axis, so as to permit easy access to both the units. This easy access facilitates desired maintenance operations of the entire molding apparatus.

The present invention also provides a sealing mechanism for the ingot heating chamber in the injection molding apparatus, which comprises an upper door for openably closing the ingot entry hole of the heating chamber, and a lower door provided immediately below the heating chamber. The lower door is vertically pivotable about a rotation shaft between a first position for closing the exit hole of the heating chamber to hold the ingot in the heating chamber in order to seal the heating chamber in conjunction with the upper door and a second position for opening the exit hole to allow the heated ingot to be discharged therethrough. The lower door, when in the second position, functions also as a vertical ingot guide for directing downward the heated ingot discharged through the exit hole. Because the lower door is the pivoting type, it can appropriately operate to seal the heating chamber without requiring a large space and without being damaged due to friction with the heated ingot. The lower door can also function as an ingot guide when in the opened position.

BRIEF DESCRIPTION OF THE ACCOMPANYING DRAWINGS

The above and other objects, advantages and features of the present invention will become apparent from the following detailed description of the preferred embodiments when read in conjunction with the accompanying drawings, in which.

DETAILED DESCRIPTION OF THE PREFERRED EMBODIMENTS

Figure 1:
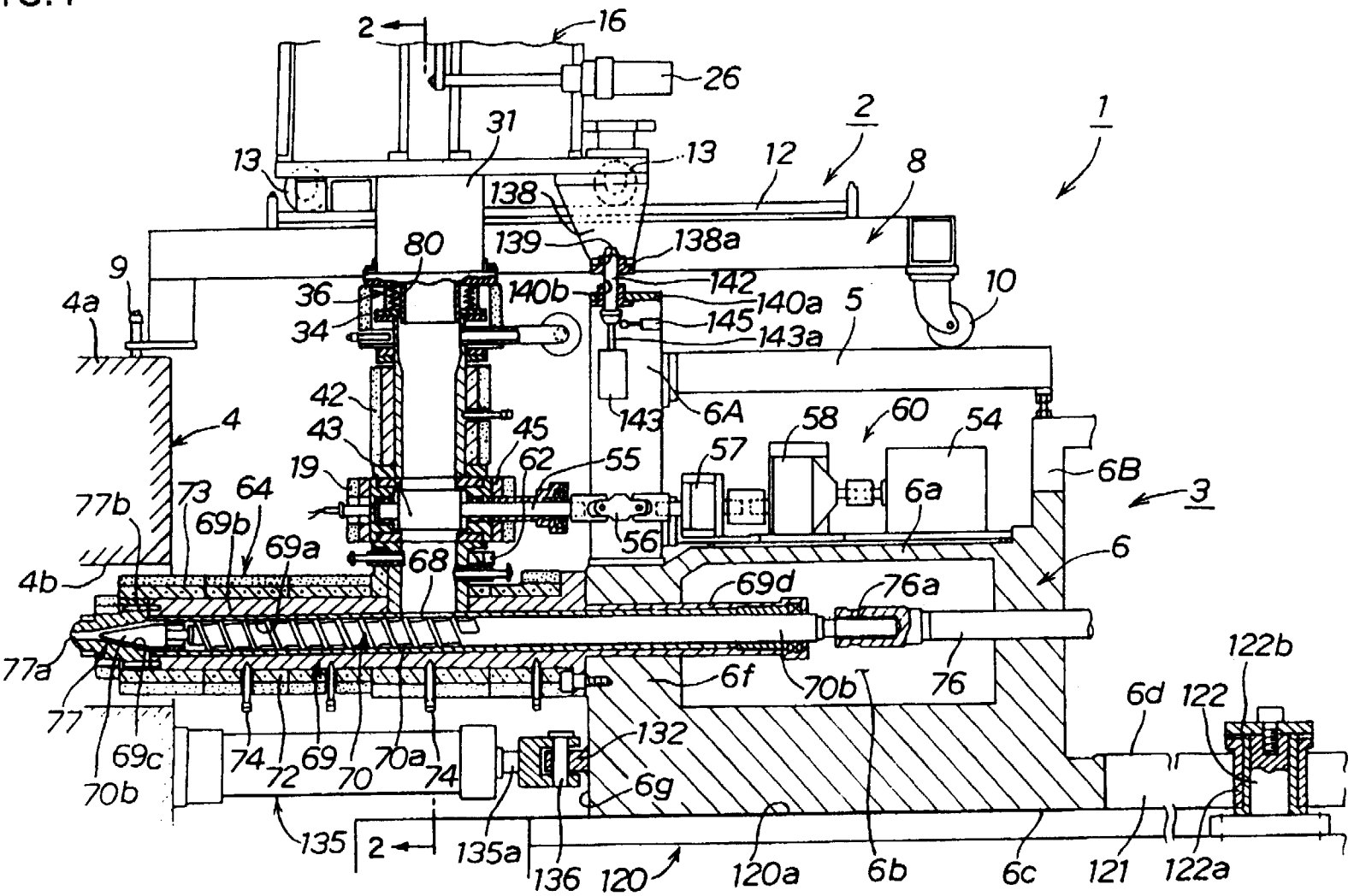
FIG. 1 is a partly-sectional side view showing the principal part of an injection molding apparatus, for manufacturing a metal molded article, according to an embodiment of the present invention.

FIG. 1 is a side view, partly in section, showing the principal part of an injection molding apparatus 1 according to an embodiment of the present invention, which generally comprises upper and lower units 2 and 3 disposed upstream of a metal mold 4.

Referring first to the upper unit 2, horizontal bridge 5 is carried by fore and rear posts 6A and 6B of a support base 6, and the rear post 6B is smaller in height (vertical length) than the fore post 6A; specifically, the bridge 5 is secured at its fore end to the intermediate portion of the fore post 6A and supported at its rear end on the rear post 6B. Horizontal upper unit support 8 has its fore end supported by a fixed platen 4*a* of the metal mold 4 via a bolt or pin joint 9 and its rear end supported on the bridge 5 via a caster 10 secured to the underside thereof. A pair of rails 12 (only one of them is shown in the figure) is provided on the upper surface of the upper unit support 8, and the upper unit 2 of the molding apparatus 1 is supported on the rails 12 via rollers 13 attached to the underside thereof.

Figure 2:
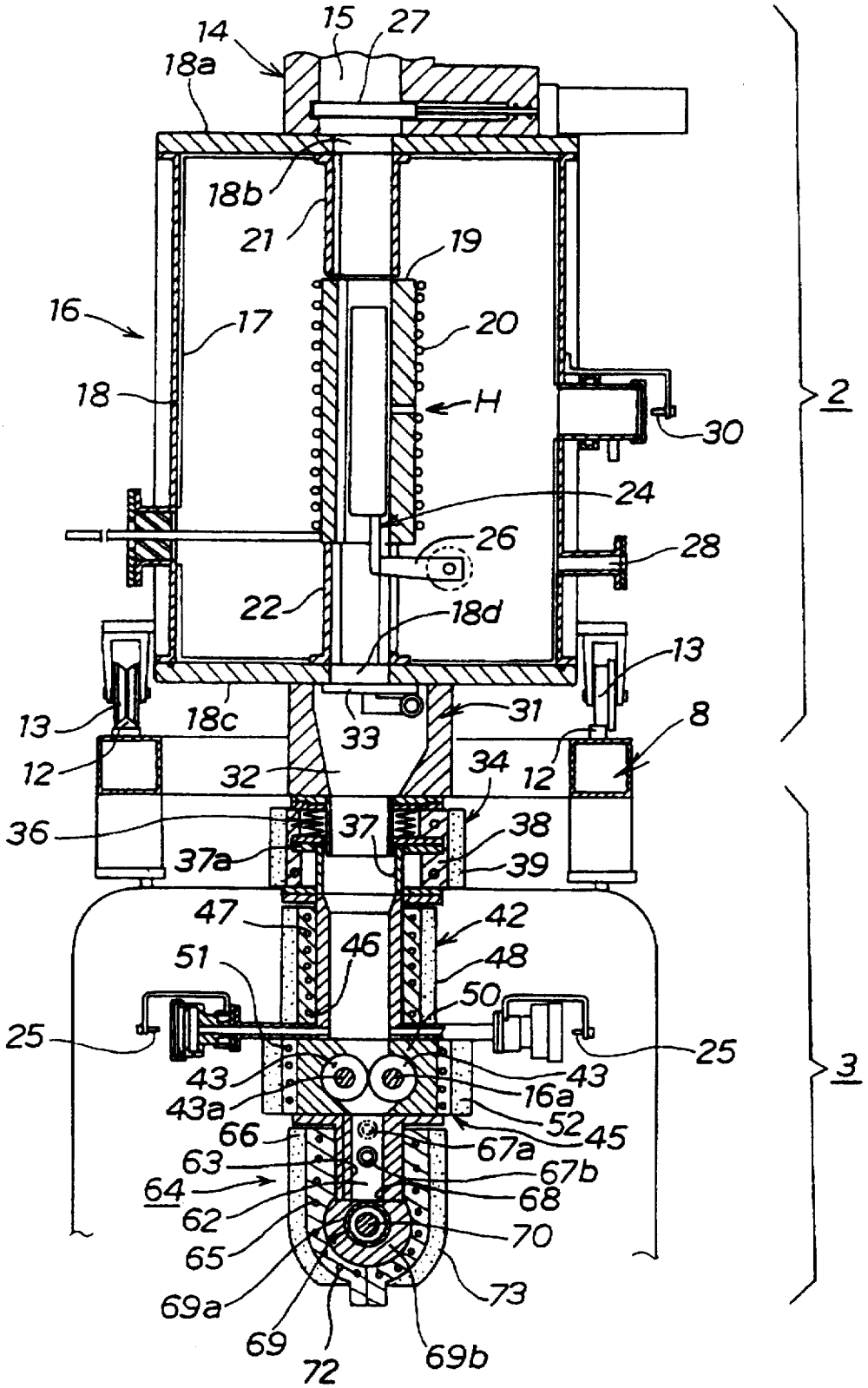
FIG. 2 is a sectional view along line A—A of FIG. 1.

As shown in FIG. 2, the upper unit 2 includes an ingot entry 14 which has an inner passage 15 for feeding therethrough an ingot or material to be molded W, such as a Mg alloy ingot, to downstream sections as will be described below.

An ingot heating chamber 16 is provided below or downstream of the ingot entry 14 for communication with the inner passage 15. The heating chamber 16 includes a sealed vacuum-heating vessel comprised of a magnetic-shielding inner wall 17 and a cylindrical outer wall 18, and an inductive heater H enclosed within the vessel. The inductive heater H is comprised of a vertical inner holder 19 formed of a ceramic material and inductive heating coil 20 wound around the outer periphery of the ceramic holder 19. As will be described below, the ingot W fed via the passage 15 of the entry 14 is temporarily held in the holder 19 so as to be heated to a predetermined temperature.

The ceramic holder 19 is supported at its upper and lower ends by vertical guide cylinders 21 and 22, respectively, and thus the holder 19 is retained vertically centrally within the vacuum-heating vessel. The ingot W is temporarily held in the holder 19, with its underside supported by a stopper 24. The stopper 24 is connected to an actuator 26 for pivoting movement in the counterclockwise direction of FIG. 2 to release the ingot W so that the heated ingot W is transferred downward by gravity.

Horizontal top cover plate 18*a* closing the top of the vacuum-heating vessel abuts against the upper end of the upper guide cylinder 21 and has a central hole 18*b* to permit communication between the passage 15 of the ingot entry 14 and the interior of the upper guide cylinder 21. Thus, the central hole 18*b* forms an ingot entry hole of the heating chamber 16.

Upper shutter or door 27 is provided, immediately above the ingot entry hole 18*b* of the heating chamber 16, for sliding movement along the top cover plate 18*a* to open or close the entry hole 18*b*, i.e., to place the passage 15 into or out of communication with the interior of the upper guide cylinder 21. When the door 27 is in the fully-opened or fully-retracted position, the passage 15 of the entry 14 is placed in full communication with the interior of the upper guide cylinder 21 and hence of the holder 19 of the inductive heater, so that the ingot W can be fed from the supply chamber 14 to the holder 19. Horizontal bottom cover plate 18*c* closing the bottom of the vacuum-heating vessel abuts against the lower end of the lower guide cylinder 22 and has a central hole 18*d* for communication of the interior of the cylinder 22 with a downstream ingot transmitting passage 32. Thus, the central hole 18*d* forms an ingot exit hole of the heating chamber 16.

In the heating chamber 16, the ingot W temporarily held in the holder 19 is heated in an inert gas atmosphere that is created by first evacuating the chamber 16 and then introducing inert gas into the chamber 16 from an external source. The evacuation and inert gas introduction are preferably effected by means of a pipe 28 provided in the lower portion of the chamber 16. Provided above the pipe 28 is a radiation thermometer 30 for detecting, by monitoring the outer atmospheric temperature around the chamber 16, when the ingot W is heated substantially to a predetermined temperature.

Vertical cylinder 31 is attached to the underside of the bottom cover plate 18*c* of the heating chamber 16 and has a hollow interior to provide a heated ingot transmitting passage 32 which communicates with the interior of the lower guide cylinder 22 to allow the heated ingot W to be transmitted toward the lower unit 3 of the molding apparatus 1. The heated ingot transmitting passage 32 has a greatest diameter at its upper end portion and gradually tapers downward so as to hold the ingot W, fed from above via the lower guide cylinder 22, in a predetermined posture.

Lower horizontal shutter or door 151 is provided, immediately below the ingot exit hole 18*d* of the heating chamber 16, for movement with respect to the underside of the bottom cover plate 18*c* to open or close the entry hole 18*d*, i.e.,, to place the lower guide cylinder 22 into or out of communication with the ingot transmitting passage 32. When the door 151 is in the fully-opened or fully-retracted position, the lower guide cylinder 22 is placed in full communication with the ingot transmitting passage 32 so that the ingot W is admitted from the cylinder 22 into the transmitting passage 32. When the upper and lower doors 27 and 151 are in the fully-closed position, the heating chamber 16 is sealed in a predetermined atmospheric condition. Thus, the upper and lower doors 27 and 151 constitute a sealing mechanism for the heating chamber 16.

The upper unit 2 of the molding apparatus 1 is movably supported on the upper unit support 8 via the rollers 13 engaging the rails 12, and the cylinder 31 defining the ingot transmitting passage 32 constitutes the lower end portion of the upper unit 2 which is connected by a flexible connector unit 36 with the upper end portion of the lower unit 3 as will be described in detail.

Referring now to the lower unit 3 of the molding apparatus 1, upper chamber 34 is provided for communication with the ingot transmitting passage 32 by way of the flexible connector unit 36 and is comprised of an inner cylinder 37, a heat-retaining heater 38 disposed around the inner cylinder 37, and an outer thermal insulating material 39 enclosing the cylinder 37 and heater 38, as shown in FIG. 2. This upper chamber 34 is in communication with a vacuum/inert gas pipe 29 (FIG. 1), through which are effected evacuation of the individual chambers of the lower unit 3 and introduction of inert gas to the chambers. Radial outward flange 37*a* is provided at the upper end of the inner cylinder 37 and coupled with a lower flange 40 of the flexible connector unit 36 as will be later described in relation to FIG. 3.

Provided downstream of the upper chamber 34 is a heat-retaining chamber 42 for temporarily holding and keeping hot the heated ingot W fed from the transmitting passage 32 of the upper unit 2 before the ingot W is sent to a downstream crushing chamber 45 provided with rotary cutters 43. The heat-retaining chamber 42 is comprised of a metal inner cylinder 46, a heat-retaining heater 47 disposed around the inner cylinder 46, and an outer thermal insulating material 48 enclosing the cylinder 46 and heater 47. At the bottom of the heat-retaining chamber 42, there is provided a detector, such as a photo detector comprising horizontally opposed light-emitting and light-receiving elements 25, for detecting presence of the ingot W within the chamber 42.

The crushing chamber 45 is provided for communication with the heating chamber 16 of the upper unit 2 by way of the transmitting passage 32, connector unit 36, upper chamber 34 and heat-retaining chamber 42. This crushing chamber 45 includes a pair of the rotary cutters 43 for crushing the ingot W into pieces, a rigid metal housing 50 receiving the cutters 43, a heat-retaining heater 51 surrounding the housing 50, and an outer thermal insulating material 52 enclosing the housing 50 and heater 51. As shown in FIG. 1, the two cutters 43 are operatively connected to a motor 54 via a drive shaft 55, universal joint 56, dual-axis gear case 57 and speed reducer 58. The drive shaft 55, universal joint 56, gear case 57, speed reducer 58 and motor 54 together constitute a drive unit 60 for the cutters 43, and this drive unit 60 is supported on the upper surface 6*a* of the base 6. The gear case 57 has one input shaft and two output shafts, so that via the drive unit 60, the cutters 43 are rotated in opposite directions to cooperatively cut the ingot W into pieces.

The crushed ingot pieces are then sent to a crushed material accumulating chamber 62 which, as best seen in FIG. 2, is comprised of a metal inner cylinder 63 connected to and extending upwardly from an injecting machine 64, heat-retaining heater 65 surrounding the cylinder 63, and an outer thermal insulating material 66 enclosing the cylinder 63 and heater 65. Upper and lower level sensors 67*a* and 67*b* are provided in the accumulating chamber 62 in order to detect a current level of the crushed ingot pieces accumulated in the chamber 62.

As best seen in FIG. 1, the injecting machine 64 includes a cylinder section 69 accommodating a screw shaft 70. The cylinder section 69 is in communication with the accumulating chamber 62 via an aperture 68 formed in the axial middle portion thereof, so that through the aperture 68, the crushed ingot pieces to be molded are introduced into the cylinder section 69 from the crushed material accumulating chamber 62 disposed above the machine 64. The screw shaft 70 is movable back and forth in the axial direction and has a spiral groove 70*a* formed along a predetermined length thereof, and thus it agitates and kneads the half-molten, crushed ingot pieces into slurry. The screw shaft 70 forces the thus-slurried material forward to the tip end portion of the cylinder section 69 by moving forward (toward the metal mold 4) while rotating in a predetermined direction and then moves back leaving the material accumulated in the tip end portion. Thereafter, once a predetermined amount of the material has been accumulated, the screw shaft 70 again moves forward to inject the accumulated material into the metal mold 4.

The cylinder section 69 is a dual structure composed of a horizontal inner cylinder 69*a* receiving the above-mentioned screw shaft 70 and an horizontal outer cylinder 69*b*. The outer cylinder 69*b* is surrounded by a heater 72 for heat-retaining (or again heating if necessary) the cylinder section 69, and the heater 72 is enclosed by a heat insulating material 73. Reference numeral 74 denotes a plurality of sensors for monitoring a current temperature of the cylinder section 69 so as to control the heat-retaining or heating operation of the heater 72 as necessary.

As shown in FIG. 1, the thus-arranged cylinder section 69 is supported at its rear end (remote from the metal mold 4) by the fore portion 6*f* of the support base 6, and the rear end 70*b* of the screw shaft 70 is connected via a joint 76*a* to a rotatable shaft 76 that is driven via a hydraulic piston unit 146 (FIG. 9) to move back and forth in the axial direction. Thus, the necessary injecting movement of the screw shaft 70 is effected in the injection machine 64 by the piston unit 146. Nozzle member 77, which forms a funnel-shaped accumulating space 69*c* at the tip of the injecting machine 64, has a central nozzle 77*a* and is removably fixed to the tip of the cylinder section 69 by means of bolts 77*b*. In the operating position as shown in FIG. 1, the fore end portion of the cylinder section 69 with the nozzle member 77 is placed within an injection port 4*b* of the metal mold 4.

According to an important feature of the present invention, the upper unit 2 which comprises the ingot entry 14, heating chamber 16 and ingot transmitting passage 32, and the lower unit 3 which comprises the upper chamber 34, heat-retaining chamber 42, crushing chamber 45, crushed material accumulating chamber 62, injecting machine 64, support base 6 and drive unit 60 are interconnected via the flexible connector unit 36, in a sealed condition, so that the ingot is transferred from the upper unit 2 to the lower unit 3 through the connector unit 36 and in such a manner to allow the lower unit 3 to vertically displace toward the upper unit 2.

Figure 3:
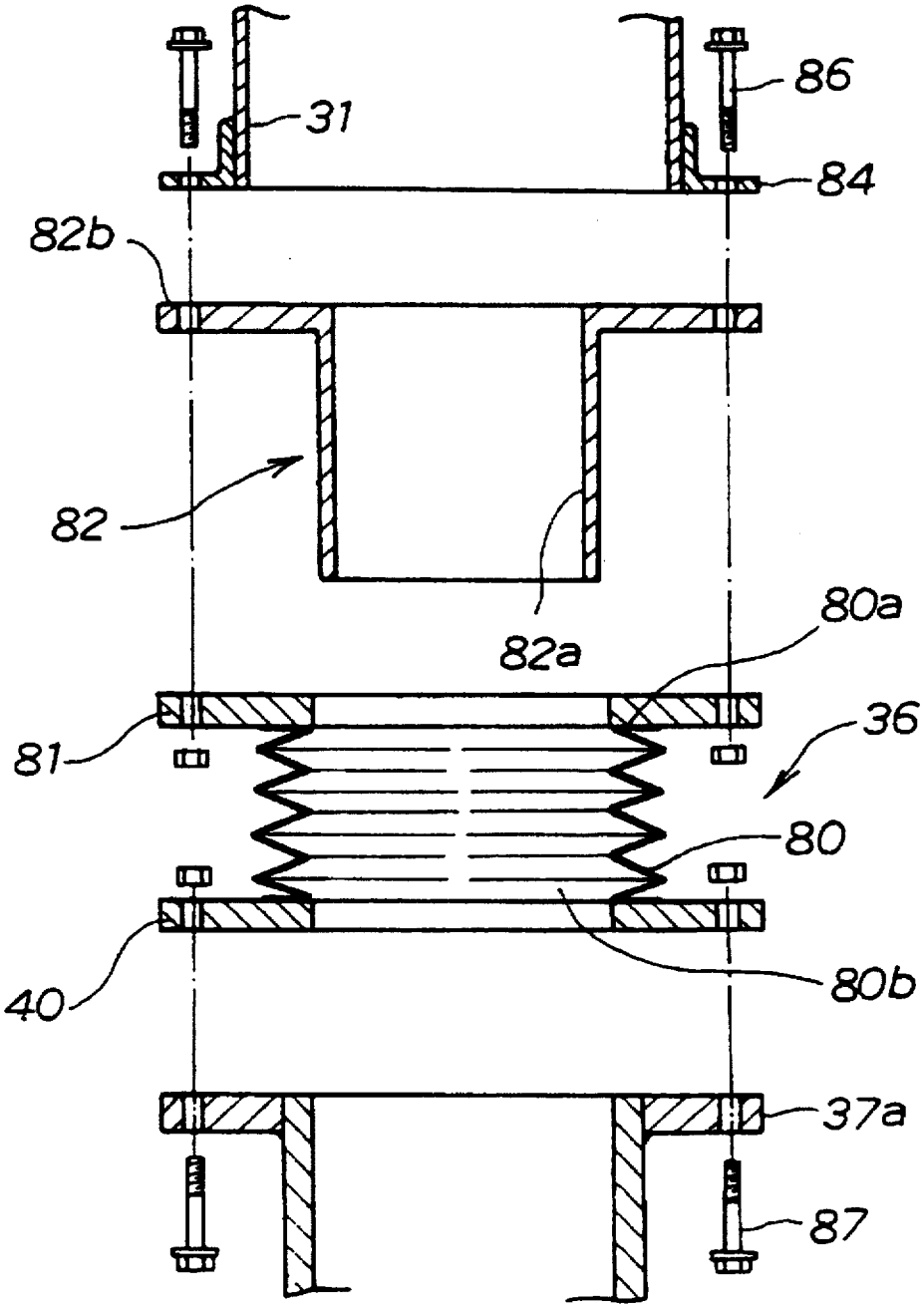
FIG. 3 is an exploded sectional side view of a flexible connector unit for interconnecting the upper and lower units of FIG. 1.

As shown in detail in FIG. 3, the flexible connector unit 36 comprises bellows 80 that may be formed of a stainless steel sheet having a good heat-resistant property. The bellows 80 is made up of a plurality of horizontal bellows elements for expanding and contracting movement in the vertical direction between the units, and the uppermost bellows element 80*a* is secured to an upper flange 81 while the lowermost bellows element 80*b* is secured to the lower flange 40.

Cylindrical ingot guide 82 is disposed within the bellows 80, and cylinder portion 82*a* of the ingot guide 82 has a length or height to extend virtually along the full vertical length of the expanded bellows 80. The ingot guide 82 also includes an integral flange 82*b* extending radially outwardly from the upper end of the cylinder portion 82*a*. As further shown in FIG. 4, mounting flange 84 having an L-shaped section is provided on the lower end outer periphery of the lower end cylinder 31 of the upper unit 2. The respective upper flanges 81 and 82*b* of the bellows 80 and ingot guide 82 are together fastened to the mounting flange 84 of the lower end cylinder 31 of the upper unit 2 by means of bolt/nut couplers 86, with each of the bolts being threaded through the mounting flange 84 of the lower end cylinder 31, flange 82*b* of the cylinder portion 82*a* and then upper flange 81 of the bellows 80. The lower flange 40 of the bellows 80 alone is fastened, by means of bolt/nut couplers 87, to the radial outward flange 37*a* on the upper end of the upper chamber 34 of the lower unit 3, in such a manner that the lower end of the ingot guide 82 is left unfastened so as to permit free vertical expansion and contraction of the bellows 80.

As assembled in the above-mentioned manner, the flexible connector unit 36 sealingly interconnects the upper chamber 34 of the lower unit 3 supported on the base 6 and the lower end cylinder 31 of the upper unit 2 supported on the frame 8 independently of the lower unit 3.

Figure 4:
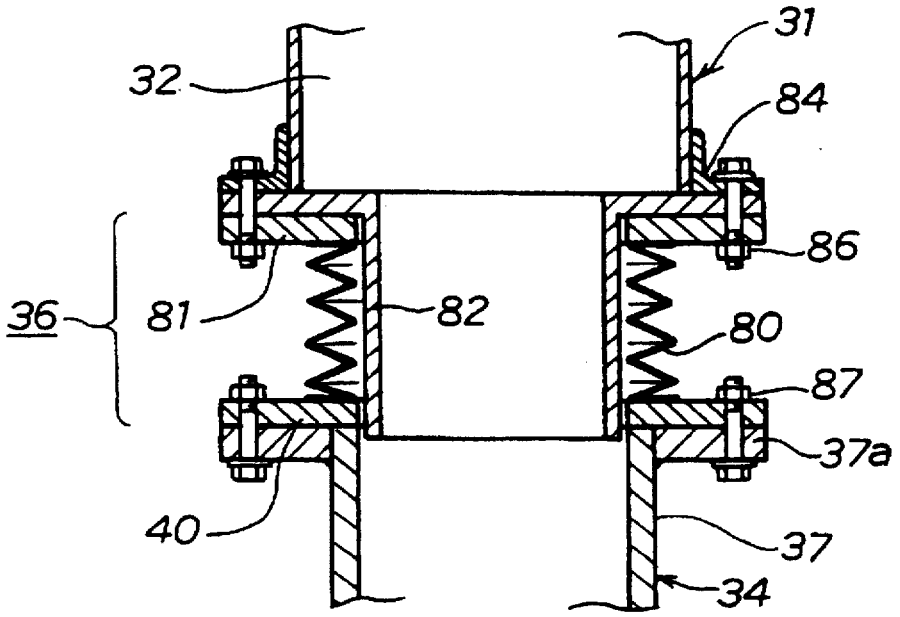
FIG. 4 is an enlarged sectional side view of the connector unit of FIG. 3 in a normal expanded state.
Figure 5:
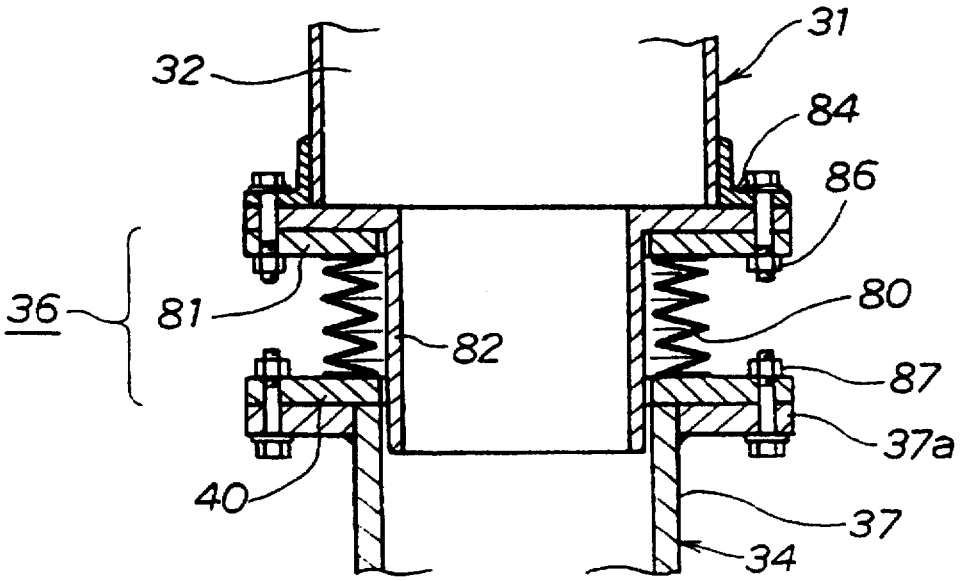
FIG. 5 is an enlarged sectional side view similar to FIG. 4 but showing the connector unit folded or contracted due to upward expansion or displacement of the lower unit toward the upper unit.

When the bellows 80 is secured in place as shown in FIGS. 4 and 5, the cylinder portion 82*a* of the ingot guide 82 lies vertically so as to function also as a part of the ingot passage in the upper chamber 34. Thus, even when the ingot W is fed through the upper chamber 34 into the heat-retaining chamber 42 in an inclined posture, the ingot W can be properly directed downward along the cylinder portion 82*a* without interfering with the bellows 80. Consequently, in introducing the ingot W into the lower unit 3 of the molding apparatus 1, the ingot W will not directly contact the bellows 80 and hence the bellows 80 will be protected from getting damaged by the ingot W.

In FIG. 4, the injection molding apparatus 1 is not in operation, and the connector unit 36, i.e., the bellows 80 is in the expanded state.

When the injection molding apparatus 1 comes into operation, the ingot W is fed from the ingot entry 14 of the upper unit 2 down to the ceramic holder 19 of the heating chamber 16 with the upper sliding door 27 retracted to the fully-closed position. Then, by retracting movement of the stopper 24 and door 151, the ingot W heated to a predetermined temperature is passed through the ingot transmitting passage 32 to the upper chamber 34 of the lower unit 3, from which it is sent to the heat-retaining chamber 42. Then, the ingot W is crushed by the cutters 43 disposed downstream of the heat-retaining chamber 42, and the crushed ingot pieces are sequentially accumulated in the accumulating chamber 62 to be fed through the aperture 68 into the cylinder section 69.

In the cylinder section 69, the crushed ingot pieces are slurried, sent to the fore end portion 70*b* of the rotating screw shaft 70 and then temporarily accumulated in the funnel-shaped accumulating space 69*c* as the shaft 70 moves back to the retracted position. Once a predetermined amount of the slurried material has been accumulated, the material is injected, by the forward movement of the screw shaft 70, into the metal mold 4 through the nozzle 77*a*.

Although the heating chamber 16 is included in the upper unit 2 of the molding apparatus 1, the outer atmospheric temperature around the upper unit 2 is compulsorily maintained cold to prevent overheating by the heating chamber 16, the outer atmospheric temperature around the lower unit 3 is left warm for the above-mentioned heat-retaining purposes. Thus, the lower unit 3 has a temperature substantially higher than the upper unit 2, so that the crushed material accumulating chamber 62, crushing chamber 45 and upper chamber 34 etc. of the lower unit 3 will more or less thermally expand upwardly toward the upper unit 2. However, according to the present invention, such thermal expansion of the lower unit 3 can be absorbed reliably and smoothly by the axial contraction of the flexible connector unit 36 provided between the upper end of the lower unit 3 and the lower end of the upper unit 2, as shown in FIG. 5.

In addition, the slurry injecting action of the screw shaft 70 in the injecting machine 64 will cause considerable mechanical shocks and vibrations. However, according to the present invention, such shocks and vibrations caused during the injection operation in the lower unit 3 can also be absorbed by the vertical flexibility of the flexible connector unit 36 so that transmission to the upper unit 2 of such shocks and vibrations is avoided or greatly reduced.

Namely, since the thermal expansion and shocks and vibrations in the lower unit 3 can be absorbed by mere provision of the flexible connector unit 36 including the bellows 80, the present invention advantageously permits a reliable, smooth injection molding operation of the apparatus 1 inexpensively with a simple construction, and defect-free ingots can be supplied from the entry 14. Additionally, with the cylindrical ingot guide 82 provided within the bellows 80 and extending virtually along the full length of the bellows 80, the ingot W can be fed through the flexible connector unit 36 without interfering with the bellows 80. Thus, the bellows 80 can be effectively protected from damage with a simple construction.

Referring back to FIG. 1, in the preferred implementation of the present invention, the rear end portion 69*d* of the cylinder section 69 extends through the fore portion 6*f* of the support base 6 into an internal hollow space 6*b*. The support base 6 is supported along its lower surface 6*c* on a fixed slide base 120 in such a manner that the base 6 is slidable on and along the fixed slide base 120 in the front-rear direction. The support base 6 has a low-profile extension 6*d* integrally formed at its lower rear end so as to provide an extension of the lower surface 6*c*.

Figure 6:
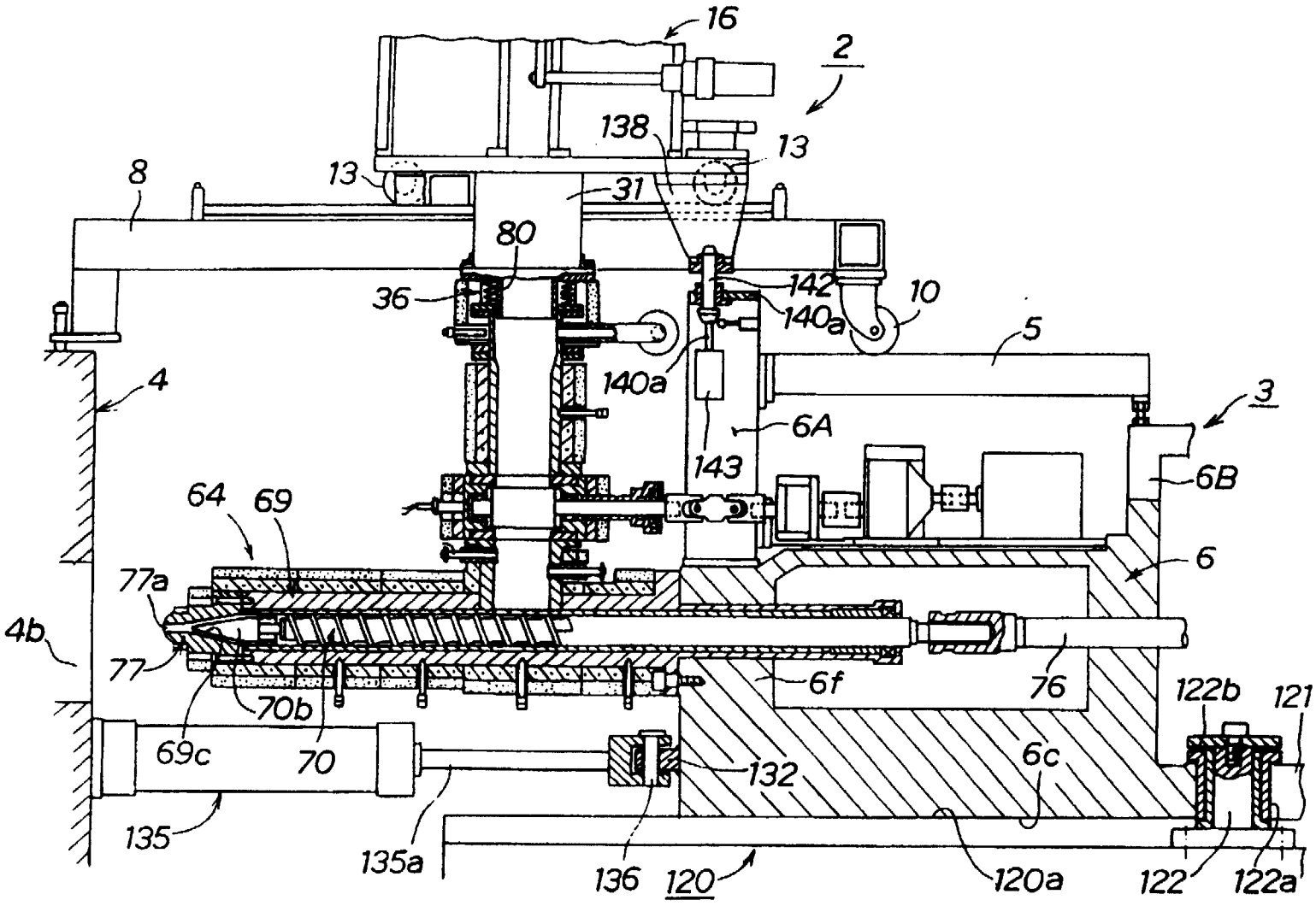
FIG. 6 is a partly-sectional side view showing the lower and upper units in a retracted position.

FIG. 6 is a sectional side view showing the upper and lower units 2 and 3 displaced together to a retracted position by moving the support base 6 away from the metal mold 4 in a manner to be described below.

The support base extension 6d has an elongated guide hole 121 extending along the axial direction of the injecting machine 64. Pin 122 is formed on the slide base 120 and projects through the elongated guide hole 121 upwardly from the slide base 120, and collar 122a rotatably fitted around the pin 122 is snugly received in the hole 121 for movement along the length of the hole 121. Reference numeral 122b denotes a stopper for preventing the collar 122a from being accidentally detached from the pin 122. Thus, via the pin 122 and collar 122a, the support base 6 is connected to the fixed slide base 120 in such a manner that it is slidable along the slide base 120 toward and away from the metal mold 4 within a predetermined extent defined by the length of the elongated guide hole 121. Importantly, the pin 122 functions as a fulcrum for pivoting movement of the support 6 with respect to the fixed slide base 120 as will be later described, and the rotatable collar 122a serves to smooth the sliding movement and pivoting movement of the support base 6.

Figure 10:
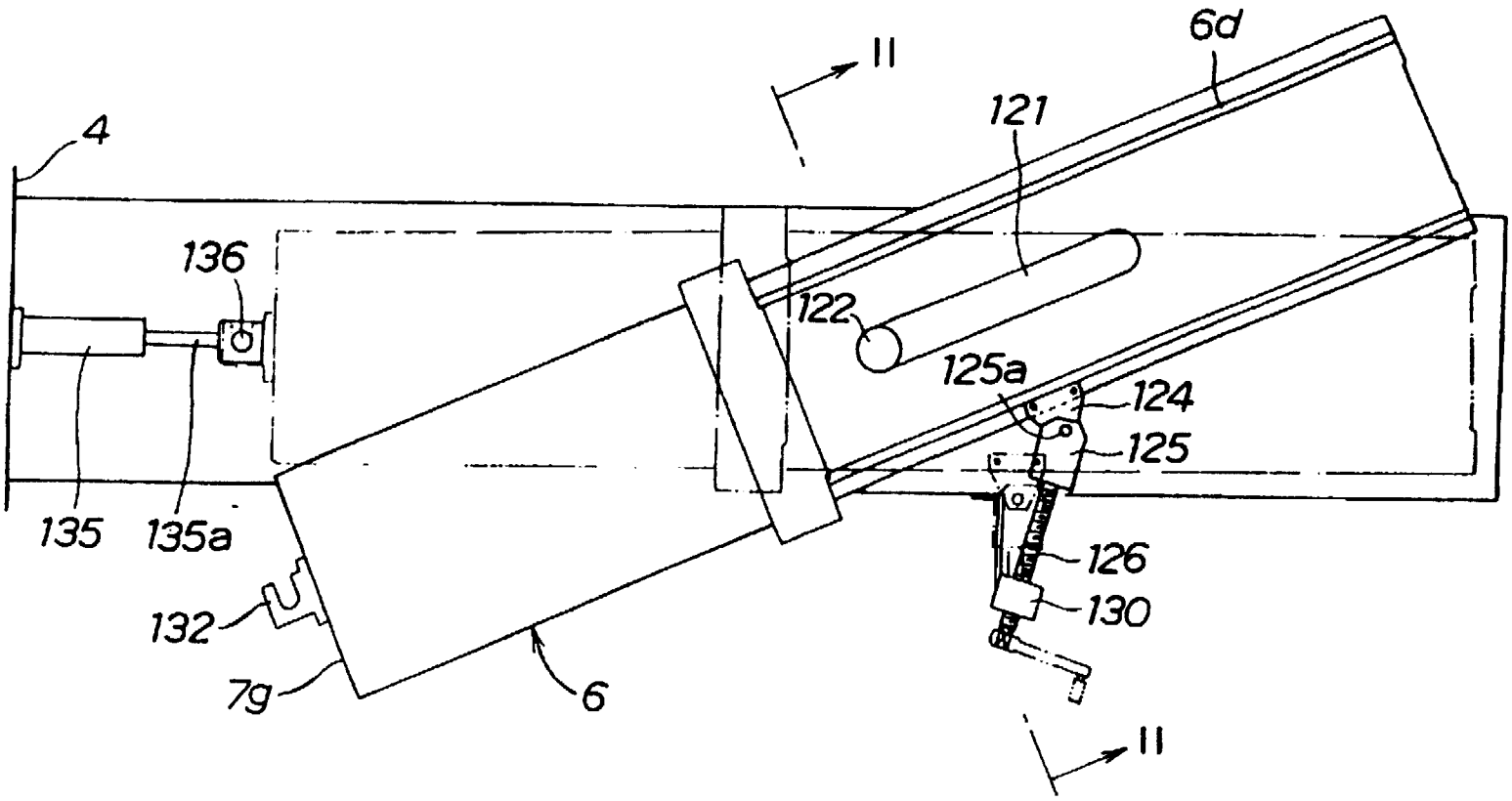
FIG. 10 is a plan view showing a support base of FIG. 6 in a laterally pivoted position.
Figure 11:
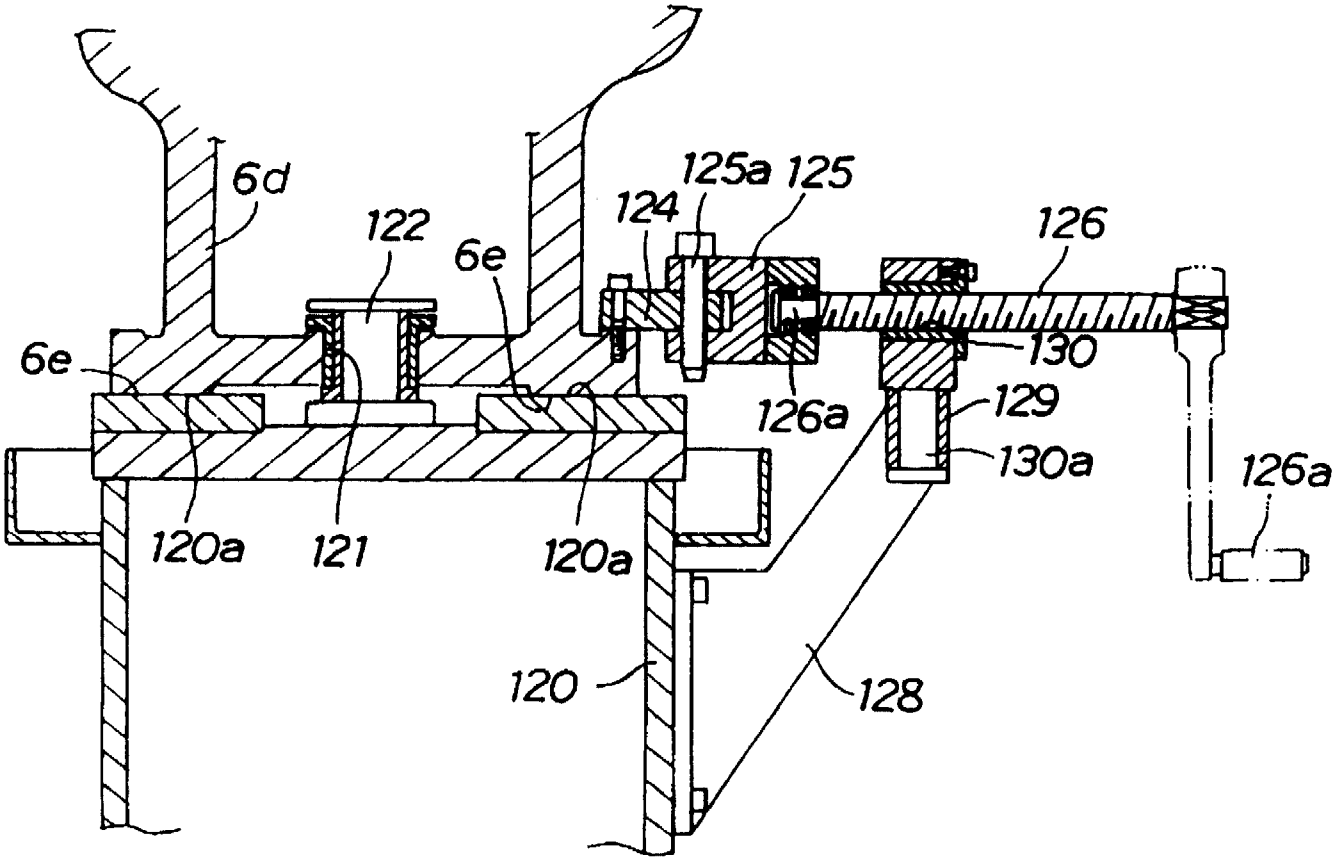
FIG. 11 is a sectional view taken along line B—B of FIG. 10.

As shown in FIG. 11, the above-mentioned slide base 120 has left and right smooth raised surfaces 120a, and left and right smooth bottom ridges 6e of the support base 6 are placed on the respective surfaces 120a for the sliding movement of the base 6. Horizontal stay 124 is horizontally pivotably connected to one side (right side in FIG. 11) of the base extension 6d, and pressing head 125 is horizontally pivotably connected to the stay 124. Horizontal threaded pressing shaft 126 is rotatably connected at one end to the head 125 and has at the other end a handle 126a. Further, bracket 128 projects laterally from the slide base 120 toward the pressing shaft 126, and vertical pin 130a is provided at the distal end of the stay 128 via a bearing 129. Nut 130 is provided perpendicularly to the pin 130a in meshing engagement with the threaded pressing shaft 126, so as to constitute a feeding thread mechanism for laterally pivoting the support base 6 about the above-mentioned pin 122 with respect to the fixed slide base 120 as shown in FIG. 10.

As seen in FIGS. 1 and 10, the support base 6 has a laterally bent locking hook 132 that is integrally formed at the fore end thereof below the cylinder section 69 of the injecting machine 64. Further, piston unit 135 is secured at one end to the outer surface (facing the support base 6) of the metal mold 4 adjacent the injection port 4b and has at the other end a piston rod 135a which is operatively connected to the support base 6 via a vertical pin 136 engaged by the hook 132, as seen from FIG. 1. As the piston unit 135 is driven to extend the rod 135a, the support base 6 is moved to the retracted position of FIG. 6, together with the lower unit 3 mounted thereon but also the upper unit 2 connected with the lower unit 3 via the above-mentioned connector unit 36; during this time, the upper unit 2 including the above-mentioned ingot entry 14, heating chamber 16 and transmitting passage 32 are moved while being supported, independently of the lower unit 3, on the upper unit support 8 via the rollers 13.

The pin 136 is normally held in engagement with the hook 132 as shown in FIG. 1, but it can be automatically disengaged from the hook 132 as the support base 6 is moved to the laterally pivoted position as shown in FIG. 10 by solid line.

Stopper 138 is formed integrally with the heating chamber 16 of the upper unit 2 to extend downward from the lower rear end thereof and includes at its lower end a locking portion 138a defining a locking hole 139.

Figure 8:
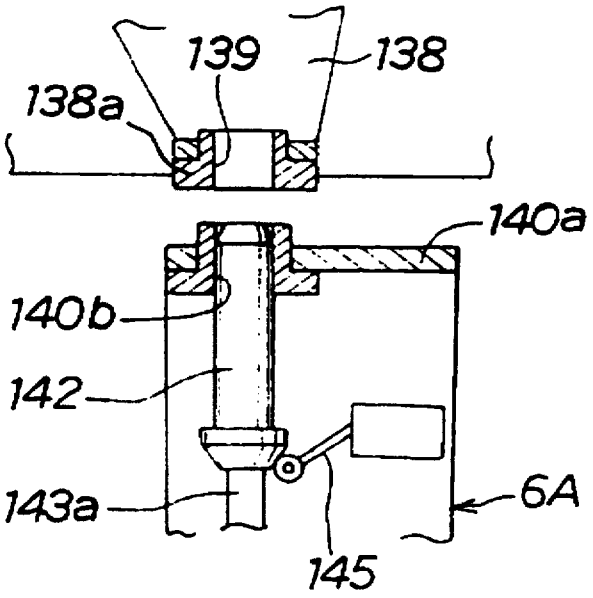
FIG. 8 is an enlarged sectional view showing how a lock pin of the lower unit is disconnected from a stopper of the upper unit.

As best seen in FIG. 8, at the upper end of the fore vertical post 6A of the support base 6, there is formed a support 140a projecting laterally therefrom, and connecting pin 142 is pierced through a guide hole 140b of the support 140a. Normally, the upper end portion of the connecting pin 142 extends through the locking hole 139 of the stopper 138 to be lockingly engaged thereby. The lower end of the connecting pin 142 is connected to a piston rod 143a of a hydraulic piston unit 143 which is in turn secured to the post 6A of the base 6, so that the pin 142 can be retracted downward by the piston unit 143 out of engagement with the stopper 138 as shown in FIG. 8. By thus disengaging the pin 142 from the stopper 138 as well as by disengaging the connector unit 36 from the upper unit 2 as will be described, the upper unit 2 can be disconnected from the lower unit 3. Microswitch 145 detects whether or not the connecting pin 142 is in engagement with the stopper 138.

Now, a description will be made about a manner in which maintenance operations are performed on the above-described injection molding apparatus 1.

To initiate desired maintenance operations when the apparatus 1 is in position of FIG. 1 where the fore end portion of the injecting machine 64 is inserted in the injection port 4b of the metal mold 4, the piston unit 135 is first activated to extend the rod 135a so as to move the support base 6 away from the metal mold 4 on and along the fixed slide base 120, so that the injection machine 64, crushed material accumulating chamber 62, crushing chamber 45, upper chamber 34, cutter drive unit 60, etc. of the lower unit 3 supported on the base 6 come to the retracted position of FIG. 6, together with the upper unit 2 connected with the lower units 3 via the connector unit 36 and connecting pin 142. At this time, the axial backward movement of the injecting machine 64 is retracted as far as allowed within the limit defined by the elongated guide hole 121, even though the slide base 120 and base extension 6d are coupled via the pin 122.

By such movement to the retracted position, the fore end nozzle 77 of the injecting machine 64 is drawn out of the injection port 4b of the metal mold 4, and the injecting machine 64 is placed sufficiently away from the metal mold Also, the pin 122 comes into abutting engagement with the fore end of the guide hole 121 in the base extension 6d.

Figure 7:
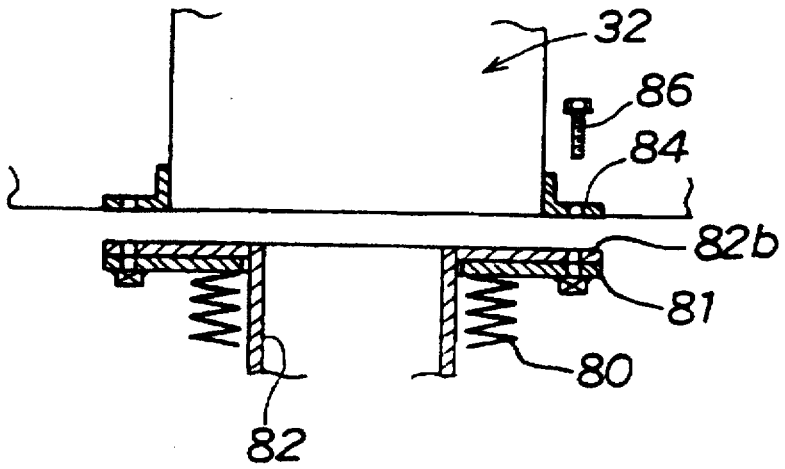
FIG. 7 is an enlarged sectional view showing how the flexible connector unit is disengaged from the upper unit.

After that, the hydraulic piston unit 143 is activated to retract the rod 143a so that the connecting pin 142 is pulled downward out of engagement with the stopper 138 of the upper unit as shown in FIG. 7. This causes the support base 6 to be disconnected from the upper unit 2. Then, the flexible connector unit 36 is disengaged from the transmitting passage 32 of the upper unit 2 by releasing the upper flanges 81 and 82b from the the bolt/nut couplers 86, as shown in FIG. 7, and as thus disengaged, the connector unit 36 contracts axially downward with the flanges 81 and 82b so as not to interfere with the upper unit 2 any longer. In the above-mentioned manner, disconnection between the upper and lower units 2 and 3 has been completed.

Figure 9:
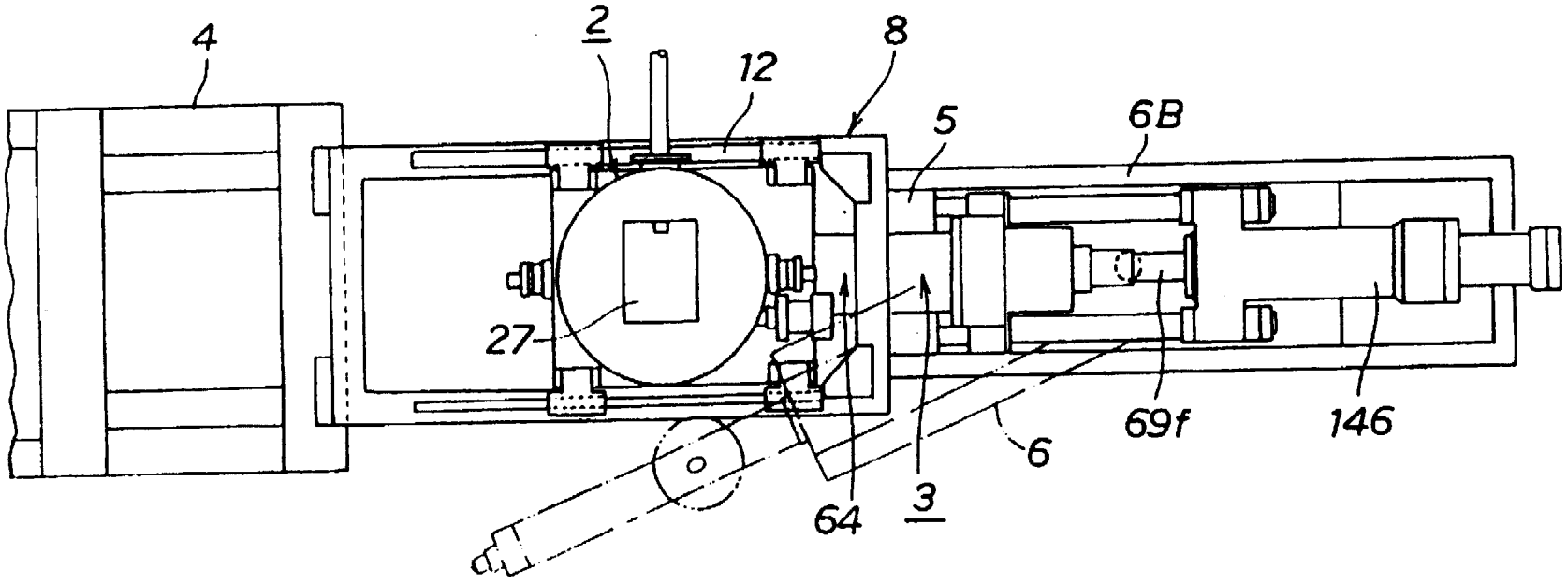
FIG. 9 is a plan view showing the lower and upper units in the retracted position.

After the disconnection, the above-mentioned threaded pressing shaft 126 is rotated by turning the handle 126a, so that the base extension 6d is pushed laterally by the shaft 126 via a horizontal pivot link that is comprised of the stay 124, pressing head 125 and nut 130. This causes the support base 6 and lower unit 3 to pivot about the pin 122 to the laterally tilted or pivoted position of FIG. 10, where the fore-half portion of the support base 6 and lower unit 3 lying forward of the pin 122 is displaced laterally from one side of the fixed slide base 120 while the rear-half of the base 6 and lower unit 3 lying rearward of the pin 122 is displaced laterally from the other side of the slide base 120 as shown. The injecting machine 64 thus laterally pivoted is shown in FIG. 9 by phantom line.

In the laterally pivoted position, not only the fore end nozzle 77 of the injecting machine 64 but also the accumulating chamber 62, crushing chamber 45 and upper chamber heat-retaining 34 are placed in such a position to not interfere with or contact the upper unit support 8. Therefore, the lower unit 3 will not interfere with the lower end transmitting passage 34 and heating chamber 16 of the upper unit 2. Because the upper unit support 8 is secured at the fore end to the platen 4*a* of the metal mold 4 and supported at the rear end on the bridge 5 via the caster 10 for lateral relative movement thereto, the heating chamber 16 and the upper unit support 8 supporting the chamber 16 will remain fixed in position even when the bridge 5 is laterally displaced with respect to the support 8 by the above-mentioned pivoting movement of the support base 6. Thus, the lower unit 3 is positioned to obliquely displace from the upper unit 2.

When, as mentioned above, the injecting machine 64 and support base 6 supporting the machine 64 in the lower unit 2 have been moved to the retracted position of FIG. 6 and then to the lateral position of FIG. 10, the injection molding apparatus 1 is ready for desired maintenance operations; therefore, such a position will be called a maintenance position for convenience of the following description.

With the above-described arrangements, the present invention greatly facilitates maintenance of the molding apparatus 1. For example, since the nozzle 77 can be retracted sufficiently apart from the fixed metal mold 4, inspection and removal for necessary repair and replacement of the nozzle 77 of the injecting machine 64—normally, the injection machine nozzle has to be replaced because of wear resulting from injection of the hot slurried material—can be carried out easily without being substantially interfered with by the presence of the mold 4, Further, by removing the nozzle 77, the fore end portion 70*b* of the screw shaft 70 located within the fore end portion of the cylinder section 69 can be exposed enough, and maintenance operations such as inspection and repair can be executed without being substantially interfered with by the metal mold 4. If necessary, the screw shaft 70 may also be replaced.

Furthermore, because the accumulating chamber 62, crushing chamber 45 and upper frame 34 connected with the injecting machine 64 can also be laterally displaced or pivoted to such a position to not interfere with the heating chamber 16 disposed above the chambers, these chambers 34, 45 and 62 can be easily inspected from above. In this position, disassemby and repair of the crushing chamber 45, replacement of the cutters 43, etc. can be performed easily and the accumulating chamber 62, upper chamber 34, etc. can be repaired with ease, without interference by the upper unit support 8 or the like.

Additionally, because the injecting machine 64 can be displaced so as not to interfere with the heating chamber 16 from below the heating chamber 16, etc. can be easily inspected and repaired from below.

In summary, the present invention allows maintenance operations of the upper and lower units 2 and 3 of the molding apparatus 1 to be performed easily, smoothly and reliably without any significant-interference between the units 2 and 3.

Another benefit is that the apparatus 1 can be shifted to the maintenance position simply, smoothly, reliably and quickly by just retracting the support base 6 with the injecting machine etc., releasing the pin joint between the upper unit support 8 and support base 6, disconnecting the flexible connector unit 36 between the upper and lower units 2 and 3, and laterally pivoting the support base 6 with respect to the upper unit support 8. The apparatus 1 can be reassembled from the maintenance position into the operable position easily and quickly by just reversing the above-mentioned procedures.

Figure 12:
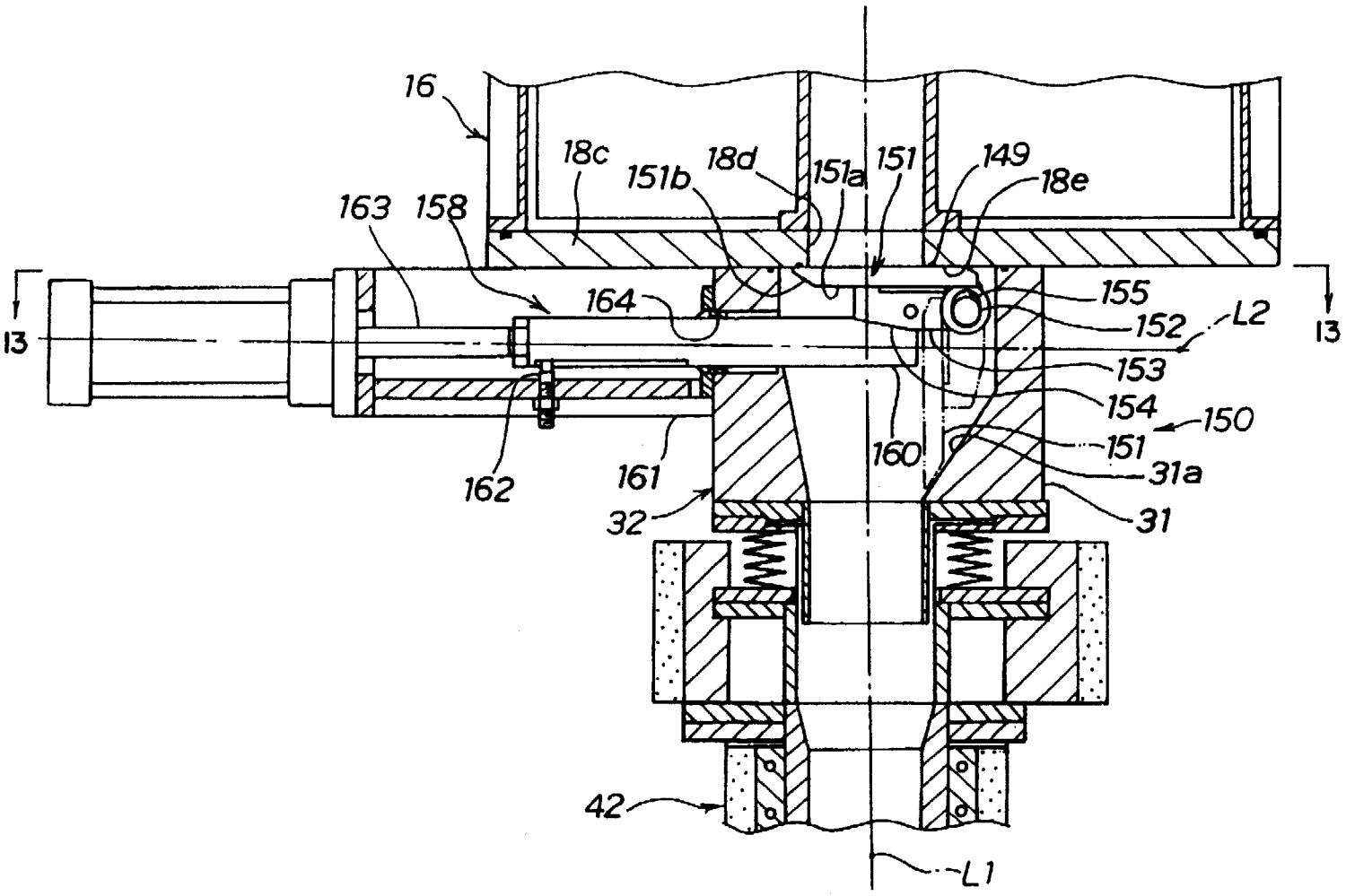
FIG. 12 is an enlarged sectional side view showing a detail of a modified sealing mechanism for an ingot heating chamber of FIG. 1.

FIG. 12 shows a detailed example of the sealing mechanism for sealing the heating chamber 16 in the molding apparatus 1, where the same reference characters as in FIGS. 1 and 2 denote the same elements as in these figures.

The sealing mechanism 150 of FIG. 12 comprises the sliding door 27 (FIG. 2) for openably closing the ingot entry hole 18*b*, and a modified lower door 151 that is a pivoting-type door rather than the sliding type. The lower door 151 is located immediately below the exit hole 18*d* formed in the bottom cover plate 18*c* closing the bottom of the heating chamber 16 and is mounted at one end on a rotation shaft 152 for vertical pivoting movement toward and away from the exit hole 18*d*. More specifically, via the rotation shaft 152, the lower door 151 is pivotable through 90° between a fully-closed position denoted by solid line and a fully-opened position denoted by two-dots-dash-line in FIG. 12.

The lower door 151 has a slant surface 151*b* on its underside 151*a* obliquely upwardly extending to the tip of the door 151. When the lower door 151 is in the fully-opened position, the slant surface 151*b* abuts against a corresponding slant surface 31*a* of the lower end cylinder 31 of the ingot transmitting passage 32, and the lower door 151 lies parallel to axial line L1 extending centrally through the heating chamber 16 and ingot transmitting passage 32 so as to function as a vertical guide for appropriately directing the ingot W (FIG. 2) downward. Sealing ring 149, preferably made of a heat-resistant alloy, is secured to the underside of the bottom cover plate 18*c* around the central hole 18*d* (peripheral surface 18*e*). When the lower door 151 is in the fully-closed position, the sealing ring 149 tightly abuts against the upper surface of the door 151 to hermetically seal the heating chamber 16.

Pressing member 153 is mounted at one end on the rotation shaft 152 and fixed to the underside of the lower door 151. The pressing member 153 has a slant surface 154 on its underside fore half, which obliquely crosses axial line L1.

The rotation shaft 152 is supported in a vertically oblong hole 155 so that it is vertically movable along the hole 155 to a slight extent when the door 151 is in the fully-closed position. The slight vertical movement of the shaft 155 within the hole 155 permits the lower door 151 to be uniformly pressed against the entire sealing ring 149 when the former is closed.

The lower door mechanism 150 also includes a door locking mechanism 158 having a locking rod 160 that is accommodated within a housing 161 and driven via a piston rod 163 for reciprocating movement along line L2 perpendicular to axial line L1. The reciprocating locking rod 160 has a wedge-shaped end portion that, as the door 151 is closed, comes into abutment against the slant surface 154 of the pressing member 153. Thus, via the cooperation between the wedge-shaped end portion of the rod 160 and pressing member 153, the lower door 151 is gradually firmly pressed against the peripheral surface 18*e*. Stopper pin 162 is provided to prevent the rod 160 from accidental pivoting, and reference numeral 164 denotes a sealing member. Although not shown, an optional cooling means is preferably provided to prevent frictional overheating of the locking rod 160 and sealing member 164.

Figure 13:
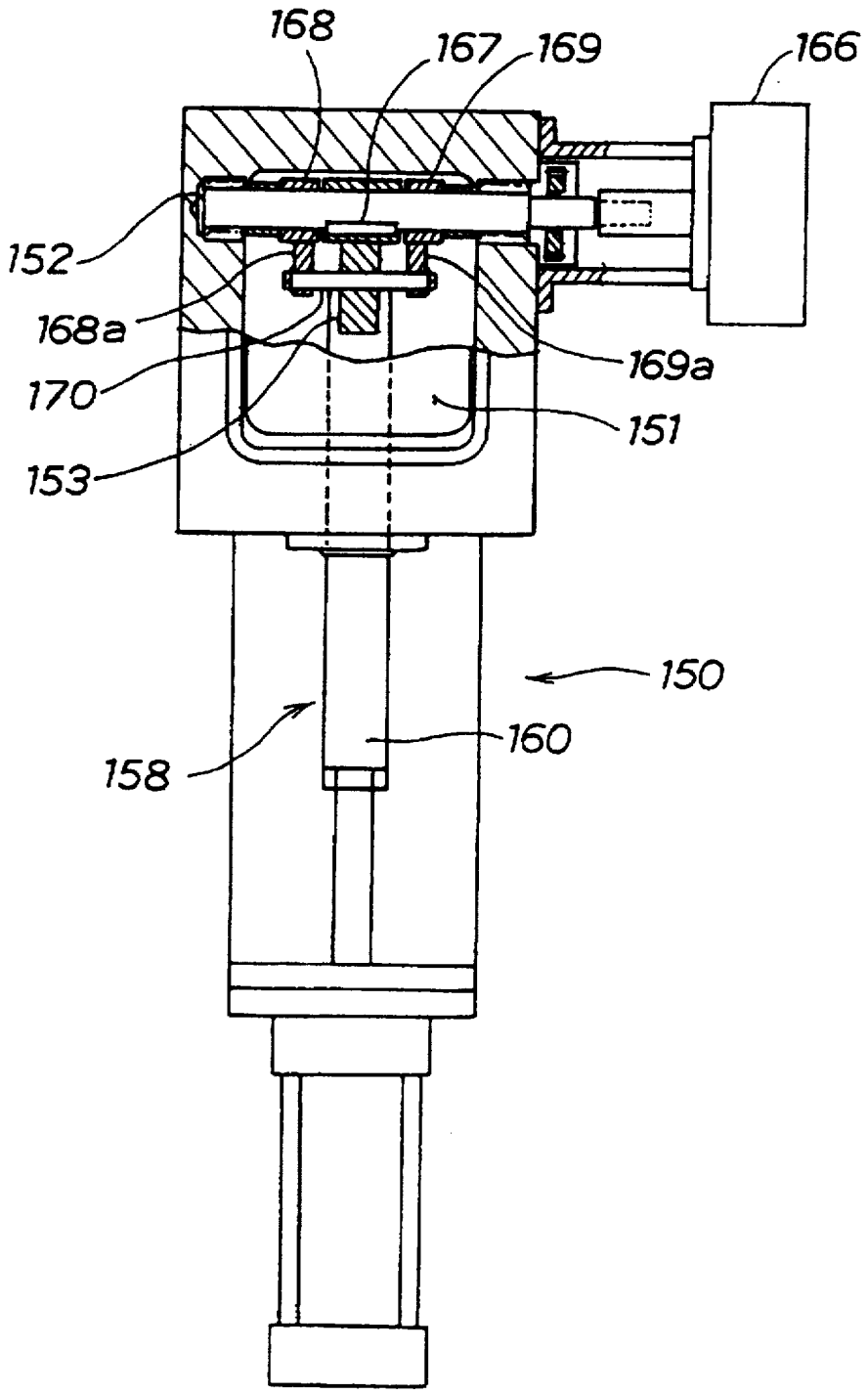
FIG. 13 is a view, partly cut away, taken along line C—C of FIG. 12.

FIG. 13 is a plan view, partly cut away, of the sealing mechanism 150 taken along line C—C of FIG. 12. As shown, rotary actuator 166 is connected with one end of the rotation shaft 152 to rotate the shaft 152. The pressing member 153 is connected to an axially central portion of the rotation shaft 152 in such a manner that it is pivotable (in the vertical direction of FIG. 12) by the rotation of the shaft 152 via a sunk key 167. Further, on both sides of the pressing member 153, a pair of annular door guide members 168 and 169 are mounted coaxially with the rotation shaft 152, which allows the lower door 151 to freely pivot about the shaft 152. The guide members 168 and 169 have respective legs 168*a* and 169*a* extending along the general plane of the pressing member 153, and connecting pin 170 is connected to and extends between the legs 168*a* and 169*a*. As the lower door 151 is pivoted to the fully-closed position, the pressing member 153 is pushed upwardly by the locking rod 160 to thereby press the connecting pin 170 against the door 151, which is thus brought into tight contact with the peripheral surface 18*e*.

Figure 14A:
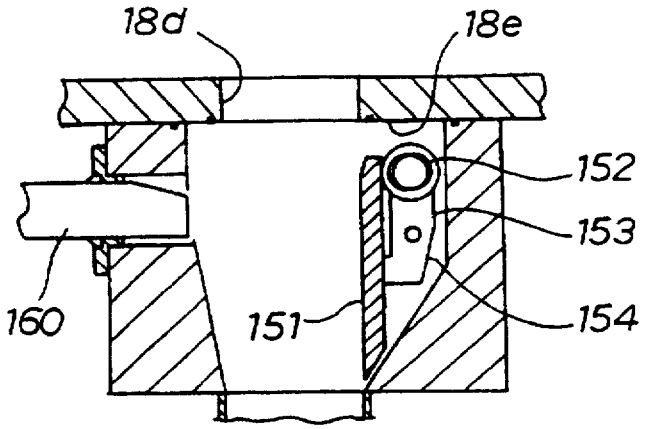
FIGS. 14A to 14C are views explanatory of the operation of the sealing mechanism of FIG. 12 when a lower door is pivoted to a closed position.
Figure 14B:
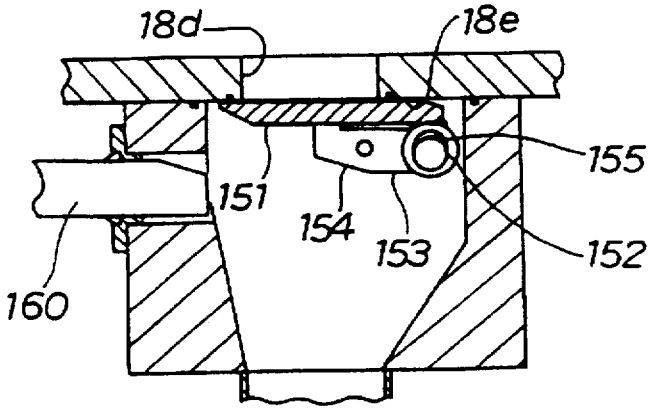
Figure 14C:
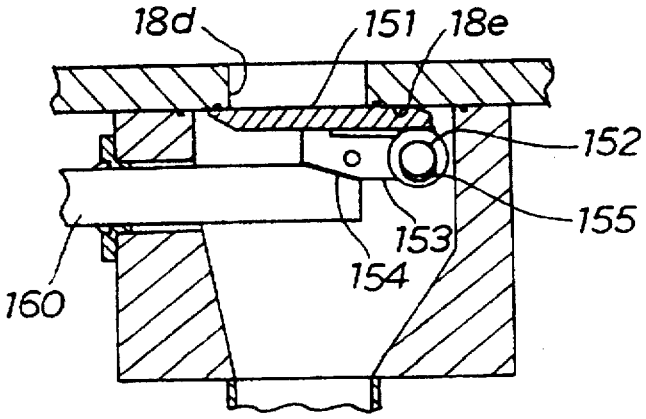

FIGS. 14A to 14C show the operation of the sealing mechanism 150 for closing the lower door 151. In FIG. 14A, the lower door 151 is shown as being in the fully-opened position. Then, the rotary actuator 166 is driven to rotate in one direction, so as to cause the lower door 151 to upwardly pivot via the rotation shaft 152 until the door 151 is brought into tight contact with the peripheral surface 18*e* as shown in FIG. 14B. After that, the locking mechanism 158 is driven to extend the locking rod 160 so that the wedge-shaped end portion of the rod 160 is pressed upwardly against the slant surface 154 of the pressing member 153. As the wedge-shaped end portion is thus pressed, the rotation shaft 152 is displaced upwardly along the oblong hole 155, and this allows the door 151 to be brought into uniform tight contact the peripheral surface 18*e* via the sealing member 149.

Figure 15A:
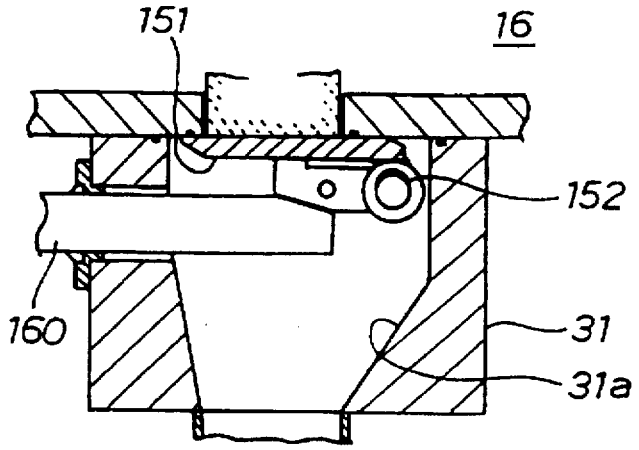
FIGS. 15A to 15C are views explanatory of the operation of the sealing mechanism when the lower door is pivoted to an opened position.
Figure 15B:
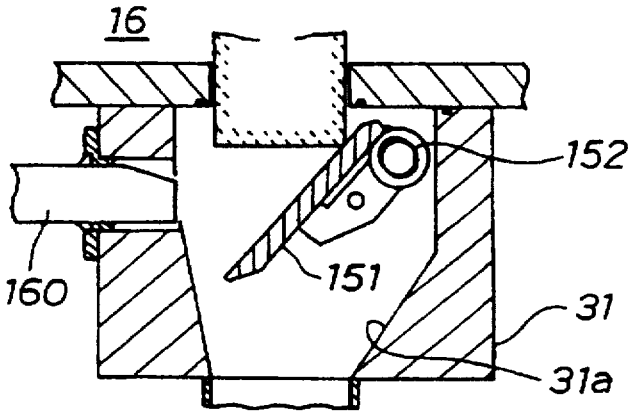
Figure 15C:
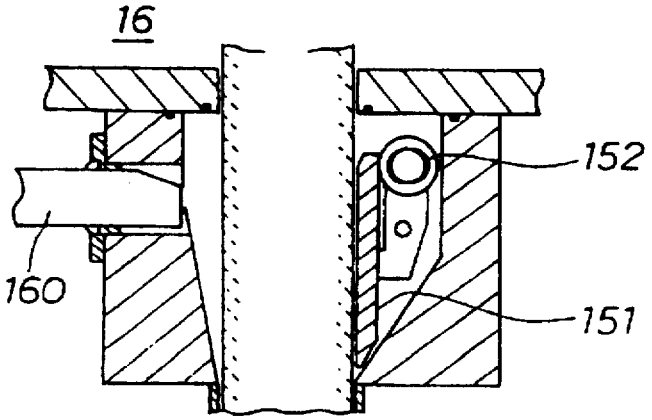
Figure 16:
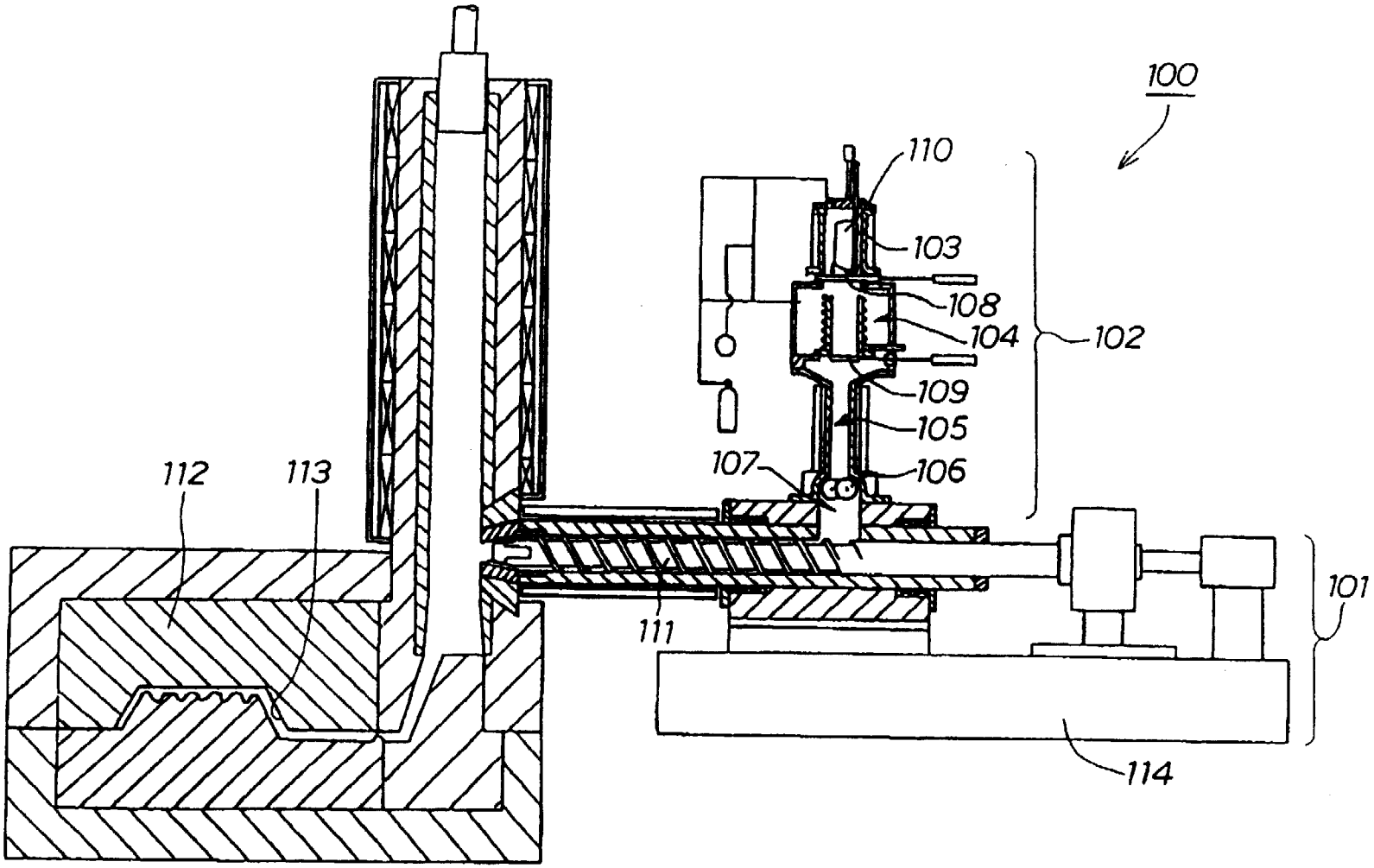
FIG.16 (PRIOR ART)
FIG. 16 is a vertical sectional view schematically showing a prior art injection molding apparatus for manufacturing a metal molded article.

FIGS. 15A to 15C show the operation of the door mechanism 150 for opening the lower door 151. In FIG. 15A, the lower door 151 is shown as being in the fully-closed position to hold the ingot W. Then, the locking rod 160 of the door locking mechanism 158 is retracted away from the pressing member 153, and the rotary actuator 166 is driven to rotate in the other direction so that the lower door 151 is caused to pivot downwardly, as shown in FIG. 15B. During that time, a brake associated with the actuator 166 is servo-controlled in such a manner to avoid a rapid downward pivoting movement of the door 151. This allows the ingot W to be transferred relatively slowly along the upper surface of the door 151 as shown, and thus the downstream transmitting passage 32 will not be damaged by the ingot W.

After that, the lower door 151 is caused to further pivot about the rotation shaft 152 into abutment against the slant surface 31*a* of the ingot transmitting passage 32 and the ingot W is smoothly transferred downwardly while being properly guided by the door 151, as shown in FIG. 15C. Because the lower door 151 is the pivoting type, it can appropriately operate to seal the heating chamber 16 without requiring a large operating space and being damaged due to friction with the heated ingot W. The lower door 151 can also function as an ingot guide when in the opened position.

What is claimed is:

1. An injection molding apparatus, for manufacturing a metal molded article, comprising:

an upper unit including an ingot entry for introducing into said apparatus an ingot to be molded and an ingot heating chamber for heating the ingot supplied via said entry to a predetermined temperature;

a lower unit disposed below said upper unit and including a crushing chamber for crushing the ingot heated by said heating chamber, and an injecting machine having an axially movable screw shaft for slurring and injecting the ingot crushed by said crushing chamber into a mold, said lower unit being mounted on a support base, said upper unit connected with said lower unit being supported on an upper unit support independently of said lower unit; and a flexible connector unit interconnecting said upper and lower units so that the heated ingot is transferred from said heating chamber to said crushing chamber through said connector unit, said connector unit being flexible in a vertical direction between said upper unit and said lower unit mounted on the support base.

2. An injection molding apparatus as defined in claim 1 wherein said flexible connector unit includes heat-resistant metal bellows, and a cylindrical ingot guide disposed within said bellows for guiding the heated ingot from said heating chamber toward said crushing chamber.

3. An injection molding apparatus as defined in 2 wherein respective upper ends of said bellows and an ingot guide are together fastened together end of said upper unit, while a lower end of only said bellows is fastened to an upper end of said lower unit with a lower end of the ingot guide unfastened to permit free vertical expansion and contraction of said bellows.

4. An injection molding, apparatus as defined in claim 2 wherein said ingot guide extends substantially along a full vertical length of said bellows so as to protect said bellows from being directly interfered with by the ingot.

5. An injection molding apparatus as defined in claim 1 wherein said support base is movable toward and away from the mold together with said lower unit mounted thereon and also said upper unit connected with said lower unit via said connector unit, and said support base is also laterally pivotable about a predetermined axis together with said lower unit white said upper unit remains fixed in position on said upper unit support.

6. An injection molding apparatus as defined in claim 5 wherein by movement of said support base toward and away from the mold, said lower unit is movable between an advanced position where said screw shaft of said injecting machine is advanced to partly project into the mold so as to inject the slurried ingot thereinto and a retracted position where said screw shaft is away from the mold, and wherein in said retracted position, said lower unit is also laterally pivotable with respect to said upper unit by disengaging said connector unit from said upper unit and by subsequently causing said support base to laterally pivot so as to permit easy access to both said units.

7. An injection molding apparatus as defined in claim 1 wherein said ingot heating chamber includes a sealing mechanism, the heating chamber having an upper ingot entry hole and lower ingot exit hole, said sealing mechanism including an upper door for openably closing the entry hole of the heating chamber and a lower door provided immediately below the heating chamber, said lower door being vertically pivotable about a rotation shaft between a first position for closing the exit hole to hold the ingot in the heating chamber in order to seal the heating chamber in conjunction with said upper door and a second position for opening the exit hole to allow the heated ingot to be discharged therethrough, said lower door in said second position functioning also as a vertical ingot guide for directing downward the heated ingot discharged through the exit hole.

8. An injection molding apparatus as defined in claim 7 which further comprises a locking rod movable between a retracted position for allowing the lower door to pivot between said first and second position and an advanced position for pressing said lower door against the lower end of the heating chamber around the exit hole so as to lock said lower door in said first position.

9. A sealing mechanism as defined in claim 8 wherein said locking rod has a wedge-shaped end portion so that said locking rod gradually locks said lower door by means of the end portion as said rod moves to the advanced position.

* * * * *